US006325321B1

(12) United States Patent
Maurer et al.

(10) Patent No.: US 6,325,321 B1
(45) Date of Patent: Dec. 4, 2001

(54) PROCESS FOR OPERATING A REEL WINDING DEVICE, A REEL WINDING DEVICE, AND A MEASURING DEVICE

(75) Inventors: Jörg Maurer, Steinheim; Alfred Schauz, Nattheim, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/435,619

(22) Filed: Nov. 8, 1999

(30) Foreign Application Priority Data

Nov. 9, 1998 (DE) ..... 198 51 483

(51) Int. Cl.[7] ..... B65H 18/20; B65H 18/26; B65H 23/04

(52) U.S. Cl. ..... 242/534; 242/542.1; 242/541.4; 242/414.1; 73/862.192; 73/862.29; 73/862.541

(58) Field of Search ..... 242/534, 542.1, 242/542.2, 542.3, 547, 541.4, 541.5, 541.6, 541.7, 414.1; 318/6; 73/862.44, 862.192, 862.29, 862.31, 862.541, 862.381

(56) References Cited

U.S. PATENT DOCUMENTS

| | | | | |
|---|---|---|---|---|
| Re. 33,399 | * | 10/1990 | Alexander | 242/542.1 |
| 2,354,952 | * | 8/1944 | Hornbostel | 242/414.1 |
| 3,611,079 | | 10/1971 | Ivey et al. . | |
| 3,858,820 | | 1/1975 | Crouse . | |
| 4,165,843 | | 8/1979 | Wedig et al. . | |
| 4,496,112 | * | 1/1985 | Olsson et al. | 242/541.4 |
| 5,289,087 | * | 2/1994 | Summey | 242/542.1 |
| 5,890,672 | * | 4/1999 | Alexander et al. | 242/542.1 |
| 6,089,496 | * | 7/2000 | Dorfel | 242/542.1 |

FOREIGN PATENT DOCUMENTS

| | | | |
|---|---|---|---|
| 2646121-A1 | * | 4/1977 | (DE) . |
| 2932396 | | 2/1981 | (DE) . |
| 4102374 | | 8/1992 | (DE) . |
| 4401959 | | 7/1994 | (DE) . |
| 4214713 | | 11/1995 | (DE) . |
| 0354566-A2 | * | 2/1990 | (EP) . |

OTHER PUBLICATIONS

Prospectus "Rollmachinen 'Baureihe Vari–Dur'", *Jagenberg*, JW 90036.

Prospectus "Technische Informationen", *Jagenberg*, III/314.

Umrollerantriebe Für die Papierindustrie, *Das Papier*, vol. 26, No. 5, pp. 205–209 (1972).

"Technologische Effekte im Doppeltragwalzenantrieb von Umrollern und Rollenschneidmaschinen durch Ausnutzung einer Leistungsverzweigung", *Wochenblatt für Papierfabrikation*, No. 6, pp. 214–219 (1967).

* cited by examiner

*Primary Examiner*—John M. Jillions
(74) *Attorney, Agent, or Firm*—Greenblum& Bernstein P.L.C.

(57) ABSTRACT

Process for winding a reel and a reel winding apparatus, as well as a measuring apparatus. The process includes determining the driving forces at the locations of the introduction of the driving force onto the reel, and determining a difference between the driving forces. The reel winding apparatus includes at least first and second drive mechanisms arranged to act on a reel to be wound, a measuring system, coupled to the at least first and second drive mechanisms, that includes a force transducer arranged in a vicinity of an introduction of force into the reel, and an evaluation device coupled to the force transducer. The measuring apparatus is provided for measuring a difference in peripheral forces between at least first and second drive elements in a reel winding device. The apparatus includes first and second contacts adapted to contact the first and second drive elements, respectively, and a transducer coupled to the first and second contacts.

40 Claims, 2 Drawing Sheets

PROCESS FOR OPERATING A REEL WINDING DEVICE, A REEL WINDING DEVICE, AND A MEASURING DEVICE

CROSS-REFERENCE TO RELATED APPLICATIONS

The present application claims priority under 35 U.S.C. §119 of German Patent Application No. 198 51 483.2, filed on Nov. 9, 1998, the disclosure of which is expressly incorporated by reference herein in its entirety.

BACKGROUND OF THE INVENTION

1. Field of the Invention

The present invention relates to a process to operate a reel winding device having at least two drive mechanisms acting on a material web roll with different driving forces during winding. In addition, the invention relates to a reel winding device having at least two drive mechanisms acting on a roll, and to a measuring device to be utilized in conjunction with the process and/or apparatus.

A reel winding device can be formed, for example, by a two-drum winder which is used to wind a material web into a wound roll. Alternatively, it can be formed by a contact roll winder in which the roll is driven both centrally by a center drive as well as by a contact roll on its circumference. The contact roll can also be embodied as a backup roll and take on at least a portion of the roll weight.

2. Discussion of Background Information

It has now been found that, when starting up reel winding devices, for example, it takes a relatively long time until both drives of the winding rolls are adjusted so that the desired winding tension and, thus, the desired winding tightness progression has been generated in the wound roll. Many problems also arise during operation that can only be alleviated by trial and error in adjusting the drive power for the individual winding rolls. The situation is complicated in that when transitioning from one material, i.e., from one type or quality, to another, different winding ratios are very often required so that one must practically run new attempts or trials for every type of material. Since the designer and the operator of reel winding devices only have limited opportunities to control the function of the king roll drives, most of the time a safe possibility is lacking for checking conformity between the preset target curves and the actual values for the peripheral force difference as a way of influencing winding tightness on the wound roll. Once there is a guarantee that the preset target curves are actually still being run, it becomes possible to begin optimizing roll quality and eliminating winding errors.

Determining the king roll peripheral forces from the electrical drive power, i.e., motor current and motor voltage, the efficiency levels of the motor and any gears that are present, and the geometric conditions, such as diameter of the winding rolls, web speed and the like is not exact enough, particularly in the acceleration phase. Even information about the efficiency of the motor and the gear is oftentimes not exact enough.

SUMMARY OF THE INVENTION

The present invention facilitates the adjustment of the drive power of winding rolls.

In this regard, the invention utilizes a process similar in general to above-mentioned process which also includes determining driving forces directly at the location of introduction into the material web roll, and generating a difference in force from this.

The driving force on every winding roll can be determined where it acts on the wound roll. The "location" of the introduction of force in this connection does not relate absolutely to the axial position, which can have a certain extension in the case of, e.g., king rolls. A preferred location where the peripheral force can be determined is a respective circumference of the winding rolls. However, it is also possible to determine the peripheral force at another position of the winding roll which has a defined connection with the surface with respect to the transmission of force. For example, it is also possible to determine the peripheral force at a roll pin that has a smaller diameter than the working circumference of the winding roll but whose surface is rigidly connected to the surface of the working area. If the peripheral forces on the winding rolls are now directly determined, it is also possible to establish with a high degree of accuracy the difference in force with which the winding rolls are acting on the wound roll. The same applies if the driving forces are determined directly on the driven core receptacle, for example, and on the circumference of the contact roll. In this case, a conversion of the driving force on the ratios prevailing on the circumference might be required, something which is possible without difficulty by using the known torque relationship. The difference in force allows a statement to be made about the tension with which the material web is being wound. Since the difference in tension can be displayed directly, adjusting the drives or the drive power is relatively simple. For example, the winding roll that first comes into contact with the paper web can be adjusted to a certain rpm and then the second winding roll can be driven in such a way that the desired torque difference and, therefore, the desired difference in force of the peripheral forces is produced.

The peripheral forces are preferably determined outside the winding process. Therefore, the determination of the peripheral forces can be conducted during start-up or when malfunctions occur without a material web being required for this purpose. This has two advantages, i.e., no unnecessary refuse is produced, and no fear of interference from a material web roll being formed.

In this connection, it may be preferable for the winding roll that first comes into contact with the material web to be braked. As a result, the web tension of the incoming material web can be simulated, i.e., a counter momentum acting against the driving power can be generated. This type of counter momentum can be applied, for example, by a roller that is pressed on the corresponding winding roll and loaded with a braking momentum.

As an alternative or in addition to determining the difference in force outside the actual winding process, measurement can also naturally take place during winding if there are free areas on the winding rolls at which the peripheral force can be to checked. These free areas can be present, e.g., axially outside the wound roll. However, it is also possible to measure in the circumferential direction at those positions that are not covered by the wound roll or the material web.

In this case, it may be preferable for the difference in force to be supplied as an actual value to a control circuit which regulates the driving of the two winding rolls in such a way that the difference in force corresponds to a preset target value. As a result, the winding tightness of the wound roll can be regulated.

In this connection, it may be preferable for the target value to have a progression that is a function of the diameter of the material web roll. Therefore, the desire for the winding tightness to diminish from the inside to the outside is taken into account. Naturally, the winding tightness is still influenced by additional factors. These factors can be taken into consideration in prescribing the progression of the target value.

The friction ratios between the material web and the respective winding roll are advantageously imitated when determining the peripheral forces. Namely, the winding rolls act on the wound roll with a certain peripheral or tangential force. However, due to the friction ratios between the surface of the corresponding winding roll and the surface of the wound roll, this peripheral force is not always transmitted completely to the wound roll. In some cases, particularly when the material web has a very smooth surface, a certain slippage is generated. If these friction ratios are now taken into consideration when determining the peripheral force, the measurement will be more precise still, i.e., the actual forces acting on the wound roll and therefore the difference in force can be measured.

The present invention also utilizes a reel winding device similar in general to the above-mentioned that also includes a measuring system, cooperating with the drive mechanisms and having a force transducer for each of the drive mechanisms. The measuring system is attached at the location of the introduction of force into the roll with the force transducer being connected to an evaluation device.

This type of reel winding device can be especially good for executing the above-described process of the invention. Due to the fact that the force is determined directly at the location of the introduction into the roll, i.e., the peripheral force is checked directly at the winding rolls or the driving force at the core drive, it is possible to determine very precisely the difference in force which is ultimately acting on the respective outer position of the material web on the wound roll. Thus, errors in calculation resulting from imprecise values in transmission coefficients can be avoided. However, if the difference in force can be determined with the desired accuracy, it is possible to establish relatively precisely during start-up or even with malfunctions in operation how the individual drive power should be adjusted so that the desired winding result is produced. The evaluation device can be formed, for example, by a common sensor for both drives which determines the difference between two forces or momentums, e.g., a torque measuring shaft with or without a display downstream.

There are many possibilities for the peripheral force transducer. For example, it may be preferable if the peripheral force transducer is formed by measuring rolls that are connected to a torque measuring shaft. The measuring rolls can also have a certain axial length and can rotate with practically a same peripheral speed. This is a prerequisite because the two winding rolls cannot have any larger differences in peripheral speed when winding the roll. The difference in speed lies in the pro mille range, i.e., one one-thousandth. For example, given a web speed of 2000 m/min, one of the king rolls can be running 2 m/min faster (or slower) than the other king roll. If the two measuring rolls are now connected to a torque measuring shaft, the torque measuring shaft rotates along with the measuring rolls. However, it rotates as a function of the difference of the peripheral forces as such, i.e., it is subject to torsional tension. This torsion can be determined, e.g., with simple wire strain gauges arranged crosswise on the circumference of the torque measuring shaft which are interconnected electrically according to a type of a bridge. As for the rest, however, the formation of torque measuring shafts is fundamentally known. They can also operate optically, for example.

The measuring rolls and the torque measuring shaft may preferably be arranged in a common carrier. Therefore, one can handle this carrier (a stand or a frame, for example) as a uniform object and, when necessary, bring it to bear against the two winding rolls. This facilitates handling. Handling can take place either manually or via a mounting device attached to the reel winding device. Naturally, it is also possible for the measuring rolls to be held permanently in the system on the winding rolls. But it is also possible to couple the measuring rolls separate from one another with the respectively driven part of the winding device. With such an arrangement, the measuring rolls can then be coupled with a transducer via flexible shafts, electrical signal generators or corresponding hydraulic units. In the latter two cases, it is also possible to dynamically modify the slippage between the measuring rollers.

The measuring rolls are advantageously arranged laterally offset with axes of rotation parallel to the torque measuring shaft. This makes it possible to determine the peripheral forces on always equal axial positions of the winding rolls. Errors that are generated by torsion in the winding rolls or the measuring rolls are thus kept to a minimum.

The measuring rolls are advantageously connected via gears to the torque measuring shaft. This has two advantages. For one, the measuring rolls can have a certain distance to the torque measuring shaft. In this connection, the gears perform the function of transmitting the rotation of the measuring rolls and the associated torque to the torque measuring shaft. For this purpose, it would be sufficient for the gear to have a transmission ratio of 1:1. However, the gear can also still be used to effect a certain transmission of rpm and torque so that the torque difference adjacent to the torque measuring shaft can be better coordinated with the torque measuring shaft. For example, the transmission ratio of the gear can be arranged in such a way that the torque difference on the torque measuring shaft increases, thereby producing a larger measuring range.

The measuring rolls may preferably have a surface that is similar to the surface of the material web in terms of the friction relative to the winding rolls. As a result, the slippage between the winding rolls and the material web can be imitated at least approximately, and what peripheral force is actually being introduced into the wound roll can be determined even more accurately.

To do this, it may be preferable for the measuring rolls to have a surface coating made of the material of the material web. Then, if a certain material web is supposed to be wound, the measuring rolls or rollers are wound up with the material web in a single or multi-layered manner. The material web can be, e.g., glued to the measuring rolls. It is important for the surface that is then formed from the material web to be able to cooperate with the winding rolls in the same manner as the wound roll does.

The measuring system may preferably include a braking device positioned adjacent to a winding roll. This braking device, e.g., a load roller, allows a web tension to be simulated using an idling winding device. However, it is also possible to propel a roller of the measuring system with an additional drive in order to be able to simulate processes during unwinding in a corresponding manner. In this case, the "braking device" functions with a reverse operational sign.

Accordingly, the present invention is directed to a process for winding a reel in an apparatus that includes at least two drive mechanisms which introduce driving forces at locations on the reel during winding. The process includes determining the driving forces at the locations of the introduction of the driving force onto the reel, and determining a difference between the driving forces.

According to a feature of the instant invention, the driving forces can be determined directly at the locations where the driving forces are introduced to the reel.

In accordance with another feature of the invention, the process can further include determining web tension based on the determined difference between the driving forces.

According to still another feature of the present invention, the driving forces can be determined outside of the winding process. The driving forces may be determined during start up. Alternatively, the driving forces may be determined during a time outside of the winding process which results from a malfunction.

According to a further feature of the invention, the process can further include determining peripheral forces as driving forces. The drive mechanisms can include a first winding roll and a second winding roll, in which the first winding roll are arranged to contact a material web to be wound onto the reel prior to the second winding roll. The process can further include braking the first winding roll.

According to another feature of the present invention, the difference between the driving forces can be measured during the winding process. The apparatus can further include a control circuit that regulates the driving of the at least two drive mechanisms, and the process can further include supplying the determined difference in driving force to the control circuit, and regulating the driving of the at least two drive mechanisms in accordance with a difference between the determined difference and a preset target value. The preset target value may be a progression that is a function of the diameter of the reel.

In accordance with a still further feature of the instant invention, the process can further include imitating friction ratios between a material web to be wound and at least one of the at least two drive mechanisms when determining the driving forces.

The present invention is also directed to a reel winding apparatus that includes at least first and second drive mechanisms arranged to act on a reel to be wound, a measuring system, coupled to the at least first and second drive mechanisms, that includes a force transducer arranged in a vicinity of an introduction of force into the reel, and an evaluation device coupled to the force transducer.

According to a feature of the invention, the force transducer can include a peripheral force transducer. Further, the peripheral force transducer can include measuring rolls coupled to a torque measuring shaft.

In another feature of the present invention, the peripheral force transducer can further include a common carrier, such that the measuring rolls and the torque measuring shaft are arranged on the common carrier. Moreover, the measuring rolls can be arranged laterally offset with axes of rotation generally parallel to the torque measuring shaft.

In accordance with another feature of the invention, the measuring rolls can be coupled to the torque measuring shaft via a geared connection.

According to still another feature of the invention, the measuring rolls can include a surface covering composed of a material that is similar, in terms of friction, to a material web to be wound onto the reel. The measuring rolls can include a surface coating composed of the material web.

In accordance with a further feature of the instant invention, the torque measuring shaft can be supported above the measuring rolls.

In accordance with a still further feature of the invention, at least one of the measuring rolls can be adapted for coupling to a drive core receptacle, and the torque measuring shaft may be positioned between the measuring rollers.

According to still another feature of the present invention, the measuring system can further include a load roller that can be adapted to be braked to apply a braking force to at least one of the at least first and second drive mechanisms.

According to a further feature of the invention, the evaluation system can include a control device adapted to control the at least first and second drive mechanisms, and the torque measuring shaft can include a transmitter for forwarding information to the control device.

In accordance with another feature of the instant invention, the evaluation system can include a display device coupled to the measuring system. Moreover, a control device can be adapted to control the at least first and second drive mechanisms in accordance with a display on the display device.

The present invention is also directed to a process of controlling the winding of a reel in an apparatus that includes first and second drive elements. The process includes driving the first and second drive elements, wherein the first and second drive elements include regions adapted to rotatably drive a reel to be wound, and determining a difference in peripheral force exerted in the regions adapted to rotatably drive the reel to be wound.

In accordance with a feature of the present invention, the determination, of the difference in peripheral force can include determining a difference in torque in the regions.

According to still another feature of the invention, the process can further include positioning a measuring system in contact with the first and second drive elements, and adjusting the first and second drive elements until the difference in the peripheral forces correspond to a preset value. The adjustment of the first and second drive elements can be utilized to adjust a web tension between the regions. The web tension can be determined from the following equation:

$$BZ = \frac{1}{b} \cdot \left( M_1 \cdot \frac{2}{d_1} + M_2 \cdot \frac{2}{d_2} \right),$$

in which BZ represents web tension; $M_1$ and $M_2$ represent torque on the first and second drive elements; $d_1$ and $d_2$ represent a diameter of the first and second drive elements; and b represents a width of the web. Further, the measuring system can be positioned in contact with the first and second drive elements during a period in which the reel is not being wound. Alternatively, the measuring system can be positioned in contact with the first and second drive elements during a period in which the reel is being wound.

The present invention is also directed to an apparatus for measuring a difference in peripheral forces between at least first and second drive elements in a reel winding device. The apparatus includes first and second contacts adapted to contact the first and second drive elements, respectively, and a transducer coupled to the first and second contacts.

According to a feature of the invention, the first and second contacts can include first and second measuring rollers adapted to be rotatably driven by the first and second drive elements, respectively, and the transducer can include a torque measuring shaft adapted to measure a difference in torque between the first and second drive elements. Further, a load roller can be adapted to exert a braking force on at least one of the first and second drive elements.

In accordance with another feature of the instant invention, the transducer can include a transmitter adapted to transmit a signal related to the measured difference in torque between the first and second drive elements.

According to yet another feature of the present invention, a common carrier can be provided, in which the first and second measuring rollers and the torque measuring shaft can be mounted for rotation within the common carrier. The torque measuring shaft may be oriented above the first and second measuring rollers, and/or the torque measuring shaft may be arranged between the first and second measuring roller.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention as described herein makes reference to a paper web as an example of a type of material web and makes reference to a two-drum winder as an example of a winding device that can be utilized in accordance with the features of the instant invention. However, these examples are intended purely for the purposes of explanation and are not to be construed as limiting in any way. In this regard, the present invention can also find application for other material webs that are supposed to be wound up in a similar manner and for contact roll winders and center drum winders. The material web rolls can have widths in a range from 0.4 to 3.8 m. The final diameter can lie in a range from 0.8 to 2.5 m. The weight of the finished rolls can lie in the range of tons.

If paper webs (or corresponding material webs) are wound into a wound roll, it is desirable to be able to have an effect on the winding tightness of the roll. One possibility for this is to drive the wound roll at the circumference and thereby allow two different peripheral forces to act on the wound roll. For example, the wound roll can be wound on a two-drum winder and the winding roll with which the material web first comes into contact at a lower momentum than the other roll can be driven. The difference between the torques is expressed in a tension introduced into the material web which is then "wound into" the roll. However, the invention is not limited to two-drum winders. The term "winding roll" should also be interpreted as an element upon which the wound roll rests having a circulating surface. The winding roll can therefore also be formed by a circulating band. The wound roll also does not absolutely have to rest on the winding roll. This type of winding roll cannot be allowed to act on the circumference of the wound roll at other locations. As mentioned above, the tension can also be generated by means of the center drive with which the roll is driven at the core and peripheral forces are applied in relation to a winding roll, i.e., the contact roll or center drum. The term "driving force" always refers to the circumference of the wound roll even if the roll is driven centrally.

Figure 1:
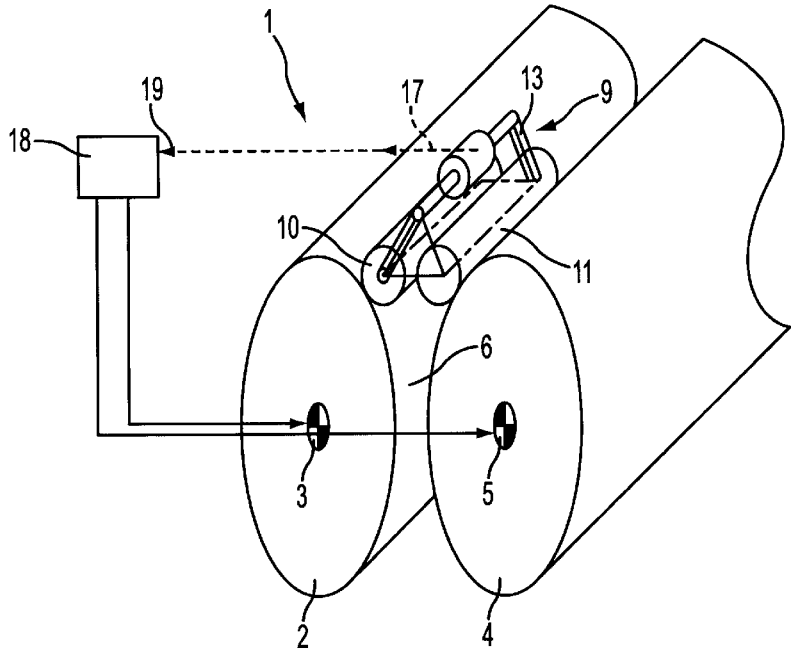
FIG. 1 illustrates a reel winding device with two-drum winders and a measuring system.

As illustrated in FIG. 1, winding device 1 includes a first king roll (winding drum) 2 with a drive 3 that is represented schematically and a second king roll (winding drum) 4 with a drive 5 that is also represented schematically. A winding bed 6 is formed between king rolls 2 and 4 in which a wound roll 7 indicated with dashed lines is situated. Wound roll 7 winds up a material web 8, e.g., a paper web.

Material web 8 initially reaches first king roll 2. Since king roll 2 is driven, material web 8 is also driven by friction and advanced in the direction of second king roll 4, which is also driven. King rolls 2 and 4 act together to set wound roll 7 into rotation.

It may be desirable to achieve a certain winding tightness progression when producing wound roll 7. The winding tightness progression is a function of a series of factors. One possibility of influencing winding tightness progression is driving king rolls 2 and 4 with different torques. In this case, different peripheral forces are generated on the surfaces of king rolls 2 and 4. Paper web 8 then is acted upon with a difference in force in the area between the bearing locations on king rolls 2 and 4 which produces a tensile stress in the outer layer of the roll. This tensile stress in paper web 8 is then "wound into" roll 7.

It is important to be able to determine the difference in peripheral forces as precisely as possible in order to be able to control the tensile stress, i.e., the web tension that is generated by the difference in peripheral force.

A measuring system 9, which is provided for this purpose, determines the peripheral forces directly on the surface of king rolls 2 and 4. These peripheral forces, therefore, are identical with the peripheral forces acting on the circumference of wound roll 7. Measuring system 9 can then be placed into the winding device in the manner of, and instead of, wound roll 7 to measure the twisting force between king rolls 2 and 4.

As an example, assume that drives 3 and 5 are torque driving motors which drive king rolls 2 and 4 with a torque M2 and M4, respectively, and that king rolls 2 and 4 have a diameter d2 and d4, respectively. The peripheral forces, e.g., U2 and U4, occur in the region in which the web is (or is to be) introduced to the material web wound roll 7, and the web width can be represented by b. In accordance with this exemplary embodiment, web tension (BZ) can be created and/or adjusted by setting and/or adjusting drives 3 and 5. In particular, web tension can be determined from the following equation:

$$BZ = \frac{1}{b} \cdot \left( M_2 \cdot \frac{2}{d_2} + M_4 \cdot \frac{2}{d_4} \right).$$

Figure 3:
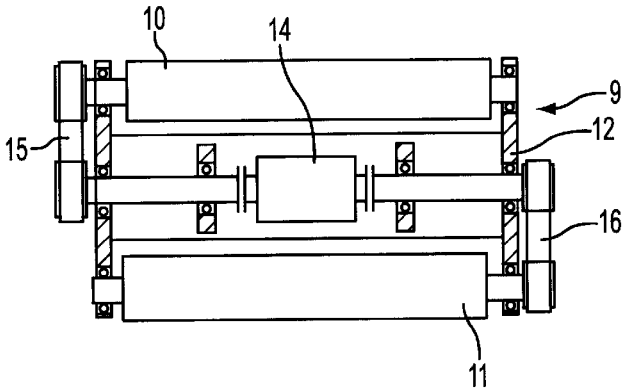
FIG. 3 illustrates a top view of the measuring system.

As may be further evident with reference to FIG. 3, measuring system 9 incudes a first measuring roller 10 adjacent to first king roll 2 and a second measuring roller 11 adjacent to second king roll 4. Both measuring rollers 10 and 11 are positioned in a common carrier 12, which is shaped like a triangle at both front sides. Measuring rolls 10 and 11 are positioned at the corner points of the triangles, namely at the base of the triangles. A torque measuring shaft 14 is positioned at a peak 13 of the triangles. Carrier 12 also includes additional braces in a manner not depicted in more detail here to counteract a twisting of the two triangles against one another. An elongated or horizontal arrangement of the measuring shaft/roller is also conceivable, for example, if sufficient space is available.

First measuring roller 10 is connected to one axial end of torque measuring shaft 14 via a toothed belt 15. The other measuring roller 11 is connected via a second toothed belt 16 to other end of torque measuring shaft 14.

Measuring rollers 10 and 11 have a same circumference. Since king rolls 2 and 4 must have the same peripheral speed when winding the roll 7, measuring rollers 10 and 11 have the same rpm when they are brought to bear on king rolls 2 and 4. Since both measuring rollers 10 and 11 act on torque measuring shaft 14 with the same transmission ratio, torque measuring shaft 14 rotates accordingly. However, different torques, which are caused by the different torques of king rolls 2 and 4, act on the two ends of torque measuring shaft 14 so that the ends of the torque measuring shaft are twisted against one another. In this manner, it is possible to measure the angle of rotation, which is a measure of the difference in torque.

Naturally, other transmission ratios can also be produced by toothed belts 15 and 1, by the toothed wheels connected to toothed belts 15 and 16, or by the pinion gear. Toothed belts 15 and 16 can form gears with their pinion gears which can also be utilized to drive torque measuring shaft 14 at a lower speed, such that a greater difference in torque acts on the two ends of torque measuring shaft 14. The measuring range can then be expanded somewhat if necessary.

Measuring rollers 10 and 11 rotate around rotational axes which are aligned parallel to the rotational axis of torque measuring shaft 14. This makes it possible to arrange measuring rollers 10 and 11 to be laterally offset next to torque measuring shaft 14. The overall length of measuring system 9 can thus be kept short. As a result, measuring system 9 can also be placed into operation if, for example, a short segment is free on one of the axial ends of king rolls 2 and 4, i.e., no wound roll 7 is resting there.

Torque measuring shaft 14 can include a transmitter, e.g., an infrared transmitter, which is schematically depicted by an arrow 17. A control unit 18 can also be provided with a receiver, which is schematically depicted with an arrow 19. Control unit 18 acts on drives 3 and 5 of king rolls 2 and 4. In so doing, it is possible to adjust the peripheral force difference in operation to a certain target value with the aid of control unit 18 and measuring system 9. It is even possible to modify the target value in operation, allowing it, e.g., to follow a preset progression. In this case, measuring system 9 is a part of control circuit 18, which ensures that the desired peripheral force difference is constantly present during winding.

This progression can be a function of the diameter of wound roll 7, which is relatively simple to determine.

Figure 2:
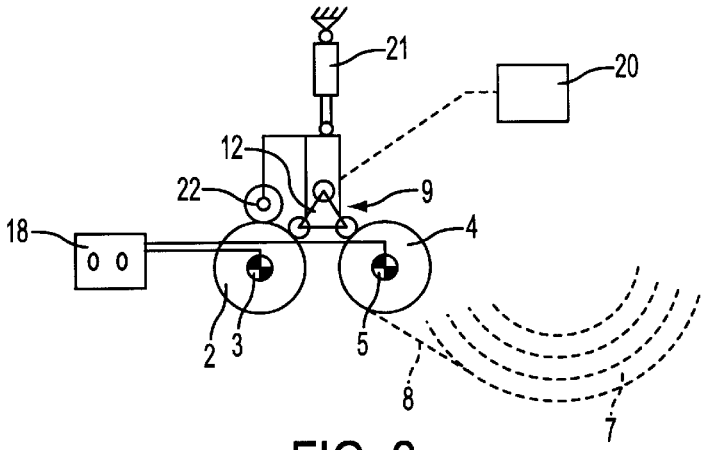
FIG. 2 illustrates a side view of an alternative embodiment to that depicted in FIG. 1.

FIG. 2 illustrates a embodiment similar to that depicted in FIG. 1, such that the same parts are assigned the same reference numbers. This time, measuring system 9 is not connected to control unit 18, but rather to a display device 20. Control unit 18 can be utilized to manually actuate drives 3 and 5. In this case, measuring system 9 is used to adjust a difference in peripheral force before the actual winding process. Measuring system 9 is brought to bear in this process on king rolls 2 and 4 with the aid of a piston-cylinder device 21. An operator then reads the peripheral force is difference from display device 20 and adjusts drives 3 and 5 with the aid of control unit 18 so that the desired difference in force or an appropriate torque appears on torque measuring shaft 14.

In order to simulate a web tension which is exerted on first king roll 2 by the incoming material web 8, a load roller 22 can be connected to carrier 12. Load roller 22, which can also be designated as a braking roller, is braked. Use of load roller 22 allows the driving momentums of king roll 2 to more closely approach the values present in operation. Alternatively, the function of load roller 22 can also be assumed by one of the measuring rollers 10 and 11.

It can be practical to wind measuring rollers 10 and 11 with material web 8 in order to simulate the friction behavior between the surfaces of king rolls 2 and 4 and material web 8. Thus, a small piece of material web 8 can be taken and glued to the circumference of measuring rollers 10 and 11. As a result, this "test coating" is connected to measuring rolls 10 and 11 so that it has torsional strength. King rolls 2 and 4 then act on measuring rollers 10 and 11 with a slippage that approximately corresponds to the slippage that king rolls 2 and 4 exert on wound roll 7.

Naturally, measuring system 9 can also be employed when using a king roll and a roll pair with bands instead of two king rolls to support wound roll 7. Measuring system 9 and the associated measurement can also be used if a difference in peripheral force is introduced, not with two king rolls, but with other rollers, e.g., a center drum or a pressure roller.

The fewest malfunctions arise when measuring system 9 is placed on the surface of king rolls 2 and 4 because the measured values correspond best to the forces acting on wound roll 7. However, if there is no space available here, it is also possible to use measuring system 9 at another location with the prerequisite that the surface available there be connected to the bearing surface of king rolls 2 and 4 transmitting a definite torque. It is conceivable, for example, for measuring system 9 to be placed on roll pins, which project through the bearing of king rolls 2 and 4. However, precisely observing all circumstances here is required, e.g., to keep the torsional tension between the roll pins and the surface of king rolls 2 and 4 from becoming errors.

Naturally, it is also possible to use a sequence of toothed wheels instead of the gear which is formed by toothed belts 15 and 16 and the pinion gear cooperating with them. As a matter of fact, it can be sufficient for two toothed wheels, which are fastened to respective measuring shafts 10 and 11, to mesh with a toothed wheel coupled to torque measuring shaft 14. A cardan shaft or a vertical shaft can also be used to transmit torque from measuring rollers 10 and 11 to torque measuring shaft.

Figure 4:
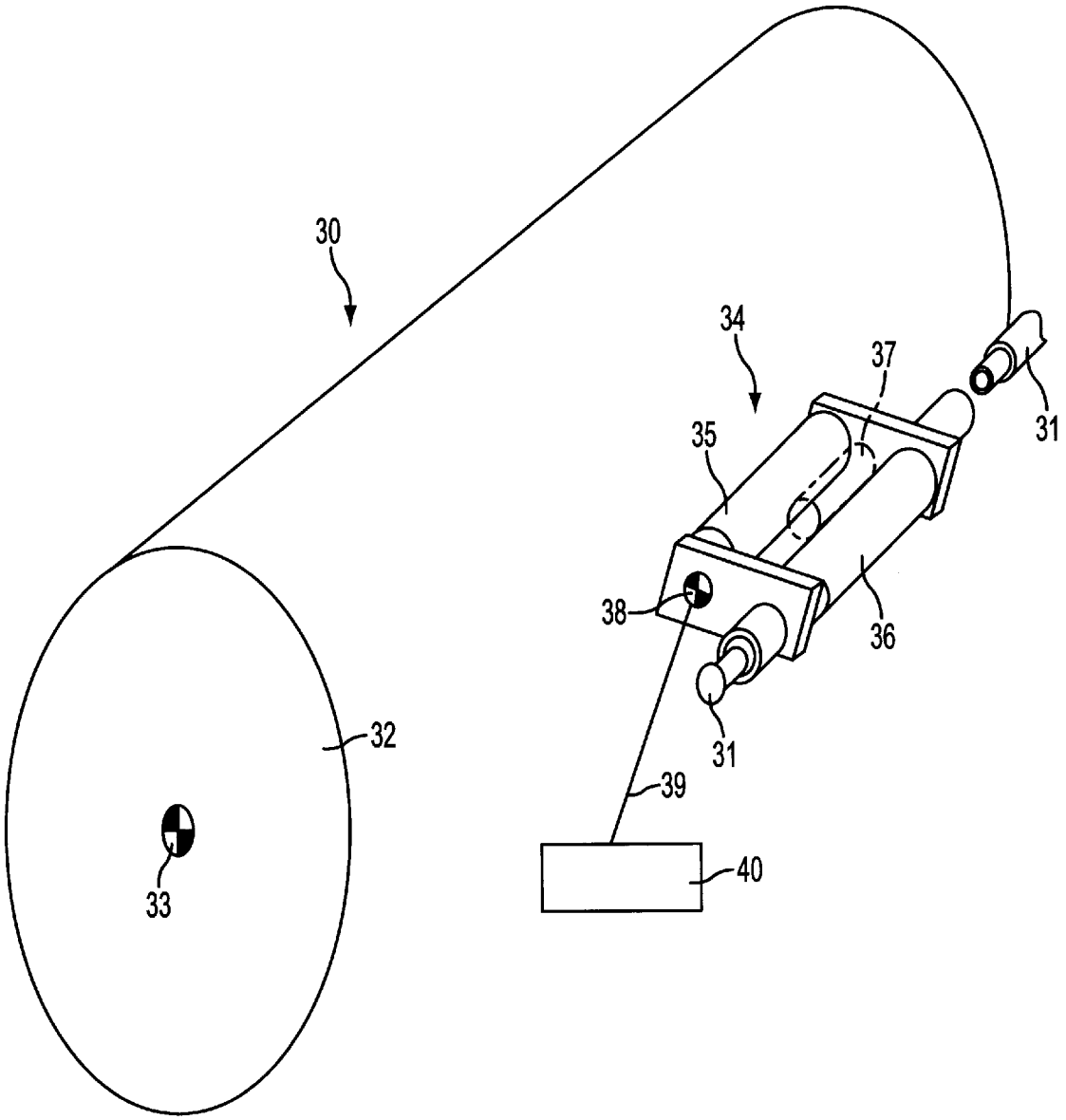
FIG. 4 illustrates a reel winding device with a central drive.

FIG. 4 illustrates a reel winding device 30 functioning in accordance with the contact roll or center drum principle. The drive of a wound roll (not depicted in further detail) takes place here by a driven core receptacle 31 which is introduced into the core of the wound roll from both sides and is braced there. In addition, a contact roll 32 is provided which also has a drive 33. To determine the differences in force acting on a subsequent wound roll, measuring system 34 includes a measuring roll 35 which can be placed against, and driven by, contact roll 32. In addition, measuring system 34 has a second measuring roll 36 into which core receptacles 31 can be introduced. Core receptacles 31 can drive measuring roll 36, e.g., via a mechanical or hydraulic gear (not shown). A torque measuring shaft 37 can be arranged between two measuring rolls 35 and 36, as indicated by the dashed line. However, as an alternative to this, it is also possible for measuring rolls 35 and 36 to drive a signal generator 38 (shown only for measuring roll 35), which has electrical lines 39 going to a control unit 40, which can control the drive of the wound roll which is to be wound subsequently, i.e., core receptacles 31 and drive 33. Alternatively, a hydraulic generator can be used instead of an electrical generator 38, such that signal transmission occurs via hydraulic lines instead of electrical lines 39.

A conversion, which can be necessary because the central drives of core receptacles 31 operate with a different rpm than drive 33 of contact roll 32, can still take place in control unit 40.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for winding a reel in an apparatus that includes at least two drive mechanisms which introduce driving forces at locations on the reel during winding, the process comprising:

determining the driving forces at the locations of the introduction of the driving force onto the reel; and determining a difference between the driving forces.

2. The process in accordance with claim 1, wherein the driving forces are determined directly at the locations where the driving forces are introduced to the reel.

3. The process in accordance with claim 1, further comprising determining web tension based on the determined difference between the driving forces.

4. The process in accordance with claim 1, further comprising determining peripheral forces as driving forces.

5. The process in accordance with claim 4, wherein the drive mechanisms include a first winding roll and a second winding roll, in which the first winding roll is arranged to contact a material web to be wound onto the reel prior to the second winding roll, and the process further comprising:

braking the first winding roll.

6. The process in accordance with claim 1, wherein the difference between the driving forces is measured during the winding process.

7. The process in accordance with claim 6, wherein the apparatus further includes a control circuit that regulates the driving of the at least two drive mechanisms, and the process further comprising:

supplying the determined difference in driving force to the control circuit; and regulating the driving of the at least two drive mechanisms in accordance with a difference between the determined difference and a preset target value.

8. The process in accordance with claim 7, wherein the preset target value is a progression that is a function of the diameter of reel.

9. A process for winding a reel in an apparatus that includes at least two drive mechanisms which introduce driving forces at locations on the reel during winding, the process comprising:

determining the driving forces at the locations of the introduction of the driving force onto the reel; and determining a difference between the driving forces, wherein the driving forces are determined outside of the winding process.

10. The process in accordance with claim 9, wherein the driving forces are determined during start up.

11. A process for winding a reel in an apparatus that includes at least two drive mechanisms which introduce driving forces at locations on the reel during winding, the process comprising:

determining the driving forces at the locations of the introduction of the driving force onto the reel;

determining a difference between the driving forces;

determining web tension based on the determined difference between the driving forces, wherein the driving forces are determined during a time outside of the winding process which results from a malfunction.

12. A process for winding a reel in an apparatus that includes at least two drive mechanisms which introduce driving forces at locations on the reel during winding, the process comprising:

determining the driving forces at the locations of the introduction of the driving force onto the reel;

determining a difference between the driving forces; and imitating friction ratios between a material web to be wound and at least one of the at least two drive mechanisms when determining the driving forces.

13. A reel winding apparatus comprising:

at least first and second drive mechanisms arranged to act on a reel to be wound;

a measuring system, coupled to said at least first and second drive mechanisms, comprising a force transducer arranged in direct contact with points on surfaces adapted to engage the reel; and an evaluation device coupled to said force transducer.

14. The apparatus in accordance with claim 13, said force transducer comprising a peripheral force transducer.

15. The apparatus in accordance with claim 13, said evaluation system comprising a control device adapted to control said at least first and second drive mechanisms; and said torque measuring shaft comprising a transmitter for forwarding information to said control device.

16. The apparatus in accordance with claim 13, said evaluation system comprising a display device coupled to said measuring system.

17. The apparatus in accordance with claim 16, further comprising a control device adapted to control said at least first and second drive mechanisms in accordance with a display on said display device.

18. A reel winding apparatus comprising:

at least first and second drive mechanisms arranged to act on a reel to be wound;

a measuring system, coupled to said at least first and second drive mechanisms, comprising a force transducer arranged in a vicinity of an introduction of force into the reel;

an evaluation device coupled to said force transducer;

said force transducer comprising a peripheral force transducer; and said peripheral force transducer comprising measuring rolls coupled to a torque measuring shaft.

19. The apparatus in accordance with claim 18, said peripheral force transducer further comprising a common carrier, wherein said measuring rolls and said torque measuring shaft are arranged on the common carrier.

20. The apparatus in accordance with claim 18, wherein said measuring rolls are arranged laterally offset with axes of rotation generally parallel to said torque measuring shaft.

21. The apparatus in accordance with claim 18, wherein said measuring rolls are coupled to said torque measuring shaft via a geared connection.

22. The apparatus in accordance with claim 18, wherein said measuring rolls comprise a surface covering composed of a material that is similar, in terms of friction, to a material web to be wound onto the reel.

23. The apparatus in accordance with claim 22, wherein said measuring rolls comprise a surface coating composed of the material web.

24. The apparatus in accordance with claim 18, wherein said torque measuring shaft is supported above said measuring rolls.

25. The apparatus in accordance with claim 18, wherein at least one of said measuring rolls is adapted for coupling to a drive core receptacle, and wherein said torque measuring shaft is positioned between said measuring rollers.

26. A reel winding apparatus comprising:

at least first and second drive mechanisms arranged to act on a reel to be wound;

a measuring system, coupled to said at least first and second drive mechanisms, comprising a force transducer arranged in a vicinity of an introduction of force into the reel;

an evaluation device coupled to said force transducer; and the measuring system further comprising a load roller, wherein said load roller is adapted to be braked, thereby applying a braking force to at least one of said at least first and second drive mechanisms.

27. A process of controlling the winding of a reel in an apparatus including first and second drive elements, said process comprising:

driving said first and second drive elements, wherein said first and second drive elements include regions adapted to rotatably drive a reel to be wound; and determining, at points adapted to engage the reel, a difference in peripheral force exerted in the regions adapted to rotatably drive the reel to be wound.

28. The process in accordance with claim 27, wherein the determination of the difference in peripheral force comprises determining a difference in torque in the regions.

29. The process in accordance with claim 27, further comprising:

positioning a measuring system in contact with said first and second drive elements; and adjusting said first and second drive elements until the difference in the peripheral forces correspond to a preset value.

30. The process in accordance with claim 29, wherein the adjustment of the first and second drive elements is utilized to adjust a web tension between the regions.

31. The process in accordance with claim 30, wherein web tension is determined from the following equation:

$$BZ = \frac{1}{b} \cdot \left( M_1 \cdot \frac{2}{d_1} + M_2 \cdot \frac{2}{d_2} \right),$$

wherein BZ represents web tension; $M_1$ and $M_2$ represent torque on the first and second drive elements; $d_1$ and $d_2$ represent a diameter of the first and second drive elements; and b represents a width of the web.

32. The process in accordance with claim 29, wherein said measuring system is positioned in contact with said first and second drive elements during a period in which the reel is not being wound.

33. The process in accordance with claim 29, wherein said measuring system is positioned in contact with said first and second drive elements during a period in which the reel is being wound.

34. An apparatus for measuring a difference in peripheral forces between at least first and second drive elements in a reel winding device, comprising:

first and second contacts adapted to contact the first and second drive elements at points adapted to engage a reel, respectively; and a transducer coupled to said first and second contacts.

35. An apparatus for measuring a difference in peripheral forces between at least first and second drive elements in a reel winding device, comprising:

first and second contacts adapted to contact the first and second drive elements, respectively;

a transducer coupled to said first and second contacts;

said first and second contacts comprising first and second measuring rollers, wherein said first and second measuring rollers are adapted to be rotatably driven by the first and second drive elements, respectively; and said transducer comprising a torque measuring shaft adapted to measure a difference in torque between the first and second drive elements.

36. The apparatus in accordance with claim 35, further comprising:

a load roller adapted to exert a braking force on at least one of the first and second drive elements.

37. The apparatus in accordance with claim 35, said transducer comprising a transmitter adapted to transmit a signal related to the measured difference in torque between the first and second drive elements.

38. The apparatus in accordance with claim 35, further comprising a common carrier, wherein said first and second measuring rollers and said torque measuring shaft are mounted for rotation within said common carrier.

39. The apparatus in accordance with claim 38, said torque measuring shaft being oriented above said first and second measuring rollers.

40. The apparatus in accordance with claim 38, said torque measuring shaft being arranged between said first and second measuring roller.

* * * * *